US009741187B2

(12) United States Patent
Shalev

(10) Patent No.: US 9,741,187 B2
(45) Date of Patent: Aug. 22, 2017

(54) DISTRIBUTED ACCESS CONTROL

(71) Applicant: xsCtrl Technologies Ltd., Bnei-Brak (IL)

(72) Inventor: Mordechi Shalev, Tel-Aviv (IL)

(73) Assignee: Mordechi Shalev, Tel-Aviv (IL)

( * ) Notice: Subject to any disclaimer, the term of this patent is extended or adjusted under 35 U.S.C. 154(b) by 0 days.

(21) Appl. No.: 15/215,615

(22) Filed: Jul. 21, 2016

(65) Prior Publication Data

US 2017/0024945 A1 Jan. 26, 2017

Related U.S. Application Data

(60) Provisional application No. 62/195,346, filed on Jul. 22, 2015.

(51) Int. Cl.
*G07C 9/00* (2006.01)
*G07C 9/02* (2006.01)

(52) U.S. Cl.
CPC ..... *G07C 9/00103* (2013.01); *G07C 9/02* (2013.01)

(58) Field of Classification Search
CPC ..... G07C 9/00309; G07C 9/00111; G07C 9/00103; G07C 9/00007; G07C 9/00166; G07C 9/00571; G07C 9/00087
USPC ..... 340/5.7
See application file for complete search history.

(56) References Cited

U.S. PATENT DOCUMENTS

2016/0210454 A1* 7/2016 Chou ..... G06F 21/44
2016/0301566 A1* 10/2016 Ramasubramani . H04L 65/1069
2017/0019264 A1* 1/2017 Nugent ..... H04L 12/282
2017/0024945 A1* 1/2017 Shalev ..... G07C 9/00103
2017/0169528 A1* 6/2017 Kundu ..... G06Q 50/14

* cited by examiner

*Primary Examiner* — Mark Blouin

(57) ABSTRACT

An access control system that comprises a storage for storing a plurality of user profiles of a plurality of users, each one of the plurality of user profiles is associated with a unique identifier of one of the plurality of users and defining access credentials of a respective the user to each of a plurality of gates, a central unit having at least one processor and an access manager module executed by the processor, and a plurality of gate control units which includes a reader to read information and a gate controller adapted to instruct an opening of at least one of the plurality of gates based on an analysis which is performed in the central unit of information extracted from an output of the reader.

17 Claims, 3 Drawing Sheets

DISTRIBUTED ACCESS CONTROL

RELATED APPLICATION

This application claims the benefit of priority under 35 USC 119(e) of U.S. Provisional Patent Application No. 62/195,346 filed Jul. 22, 2015, the contents of which are incorporated herein by reference in their entirety.

FIELD AND BACKGROUND OF THE INVENTION

The present invention, in some embodiments thereof, relates to control access gates and, more specifically, but not exclusively, to centralized gate access control.

Security systems for controlling accesses to a restricted area are very common today. Apartment complexes, gated communities, individual residences, office complexes and research facilities often have these systems. At a minimum they consist of security gate at an entrance.

Over the years, these systems have become quite sophisticated and consist of systems controlled by computers. In larger systems this can include a primary computer located at a central control office that connects through local telephone lines or a separate private communication system to the gate controller units at several gated access entry locations around the restricted area. The local unit at each gated entry has its own computer controlled system. The local system at each gate will typically have saved in computer memory various access codes that occupants of the secure area can enter by keypad, transponder or otherwise to open the gate and gain access. The local units at each gate will typically have a communication unit that includes a display and directory of occupants so an individual arriving at the gate can contact a party in the restricted area and thereby gain entry. These systems typically have diagnostic systems that allow the central control office to monitor operation of the local units and diagnose operational problems at the local unit.

SUMMARY OF THE INVENTION

According to some embodiments of the present invention, there is provided an access control system. The system comprises a storage for storing a plurality of user profiles of a plurality of users, each one of the plurality of user profiles is associated with a unique identifier of one of the plurality of users and defining access credentials of a respective the user to each of a plurality of gates, a central unit having at least one processor and an access manager module executed by the processor, a plurality of gate control units each having: a reader to identify a unique identifier of one of the plurality of users, a network interface for transmitting the unique identifier to the central unit via a computer network and to receive from the central unit a message indicative of approving or rejecting an access of a user identified with the unique identifier to a physical location associated with respective the gate control unit, and a gate controller adapted to instruct an opening of at least one of the plurality of gates based on an analysis of the message. The access manager module generates the message based on a match between the unique identifier and data from a respective the user profile.

Optionally, the access manager module registers a presence of the user in a log when the unique identifier is identified.

Optionally, the access manager module adds to the message promotional content related to a location of a respective the gate control unit.

Optionally, the access manager module sends a mobile device message to a client application running on a mobile device of the user in response to a compliance with a rule and the approving or the rejecting of the access of the user.

More optionally, the client application is adapted to extract from respective the user profile information of an access permits to a plurality of locations via at least some of the plurality of gates and to instruct a display of the information on a display of the mobile device.

Optionally, the access manager module sends an SMS message to a client application running on a mobile device of the user based on an update to a respective the user profile.

Optionally, the plurality of gate control units is installed to control a plurality of car gates and pedestrian gates which are disconnected from one another.

Optionally, the plurality of gate control units is installed in a plurality of different buildings.

Optionally, at least one of the message and the user identifier is encrypted using a cryptographic hash function.

Optionally, the system further comprises at least one operator module adapted to be executed by a processor so at to allow an operator to edit at least some of the plurality of user profiles.

More optionally, the at least one operator module is adapted to display a notification about the opening of the at least one gate.

Optionally, the access manager module sends a mobile device message to a mobile device of the user in response to a compliance with a rule and the approving or the rejecting of the access of the user and based on a number acquired from a respective the user profile.

Optionally, the reader is an image sensor adapted to read the unique identifier from a machine readable tag presented on a screen of a mobile device of the user.

Optionally, the reader is an image sensor adapted to detect a signal encoding the unique identifier and transmitted by a mobile device of the user.

Optionally, each of the plurality of gate control units comprises a module for matching the unique identifier with local data and to instruct the network interface to transmit the unique identifier to the central unit when no locally found.

According to some embodiments of the present invention, there is provided a method for access control that comprises at a central unit: storing a plurality of user profiles of a plurality of users, each one of the plurality of user profiles is associated with a unique identifier of one of the plurality of users and defining access credentials of a respective the user to each of a plurality of gates, at one of a plurality of gate control units installed to control a plurality of electronic gates: identifying a unique identifier of one of the plurality of users, transmitting the unique identifier to the central unit via a computer network and to receive from the central unit a message indicative of approving or rejecting an access of a user identified with the unique identifier to a physical location associated with respective the gate control unit, and instructing an opening of at least one of the plurality of gates based on an analysis of the message. The central unit generates the message based on a match between the unique identifier and data from a respective the user profile.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE SEVERAL VIEWS OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings.

DESCRIPTION OF SPECIFIC EMBODIMENTS OF THE INVENTION

Figure 1:
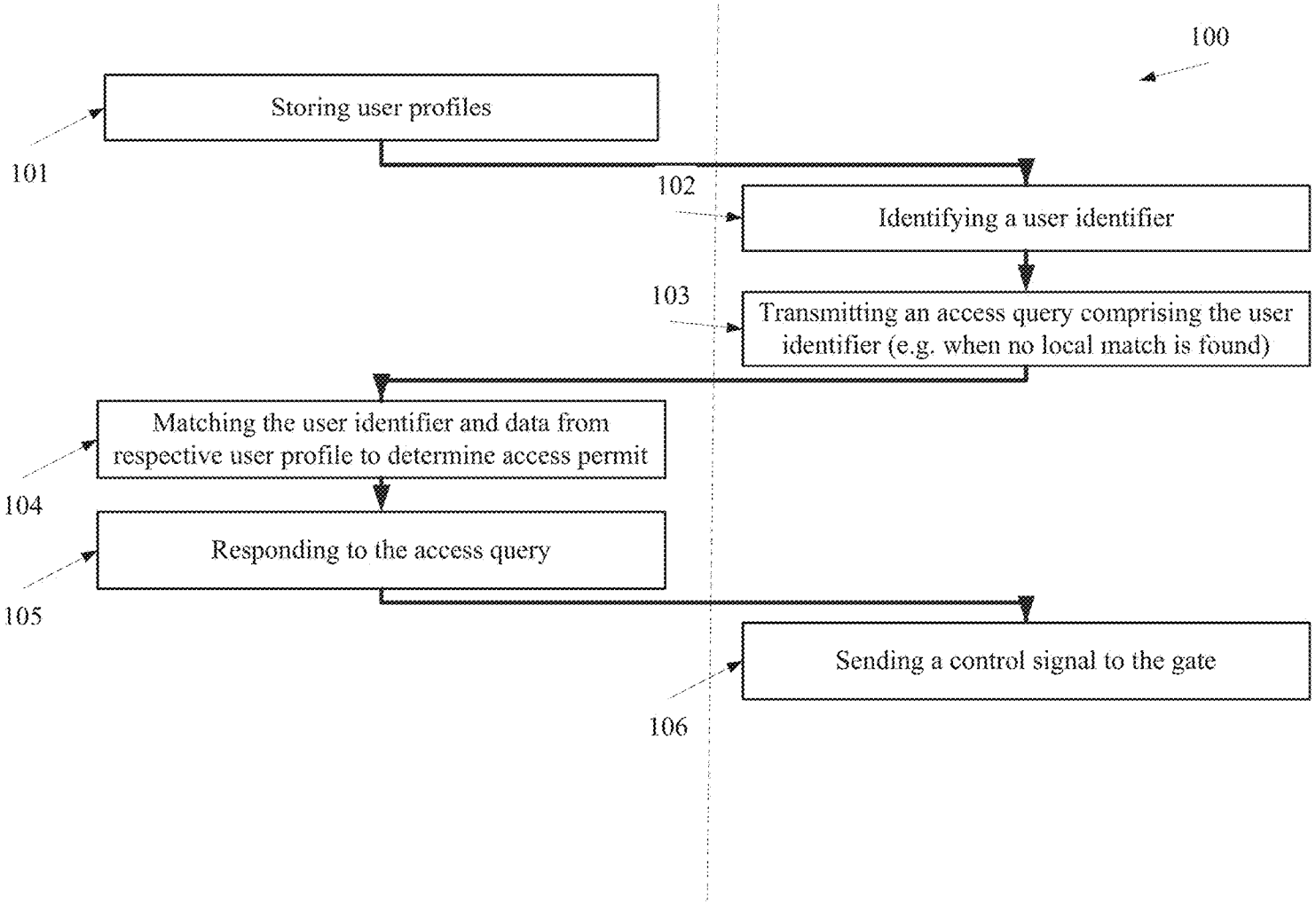
FIG. 1 is a schematic illustration of a method of managing access credentials of a plurality of users to a plurality of different and separated areas by using a plurality of gate control units to control various access control gates based on readings from a reader, according to some embodiments of the present invention.

The present invention, in some embodiments thereof, relates to control access gates and, more specifically, but not exclusively, to centralized gate access control.

According to some embodiments of the present invention, there is provided a server based solution to manage access of users to various locations by controlling gate control units which are added to control a plurality of access gates (e.g. distributed in various geographical locations) according to centrally managed user credentials.

The gate control units may be added to existing access gates, for instance by an integration that allows controlling the access gates based on the reading of a proximate barcode (e.g. quick response (QR) code), for instance from a display of a mobile device and/or a wireless signal (e.g. NFC signal, Bluetooth message, and/or Wi-Fi message). In use, a gate control unit extracts a unique identifier of a user, forward the unique identifier to a central service or to a local match with local data, and receives a command to operate one or more access gates accordingly. The communication with the central service, where needed, may be secured, for instance using a cryptographic hash function. The local data may be updated when a new access code is added. In such embodiments, remote access to the central unit may be performed only when a valid access token or credentials cannot be found for the user identifier.

Optionally, the cloud computing solution integrates location based advertising solutions, allowing sending the user promotional content based on his request to access a certain location. Additionally or alternatively, the cloud computing solution integrates location based billing solutions, allowing the user to pay securely for services which are provided in the certain location, for example for access or parking. The billing and/or advertisement may be performed based on information extracted from user profiles which are centrally managed by one or more servers.

According to some embodiments of the present invention, user interface that allows operators to update user profiles may be updated in real time, either centrally and/or distributable in local database at the access gate level. For instance a user profile of a visitor may be added to the system, for example by providing a contact details (e.g. user email, cellular number, and 'personal identification number) and a visiting period. In use, a user profile record is created with a user identifier, allowed areas definitions (e.g. which access gates should be open for the user) and a visiting period, for instance time and day. The allowed areas may be deduced from the credentials of the operator and/or inputted manually by the operator. The system may forward to the visitor (using the contact details) a barcode that is generated according to the user identifier and/or a message indicating that he or she can use a client application to access the respective location. Upon arrival at the respective access gate, the user can present the barcode, for instance on the screen of his mobile device, or operating an application to transmit an NFC signal, allowing a reader of the gate control unit to extract an encoded user identifier. The user identifier may be locally matched against data in a local database for authentication and/or forwarded to a central server for authentication using the respective user profile. The user profile may be updated by the operator. Optionally a log of the given credentials and access requests is kept per user.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

The present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

Reference is now made to FIG. 1, which is a schematic illustration of a method of managing access credentials of a plurality of users to a plurality of different and separated areas by using a plurality of gate control units to control various access control gates such as car gates and pedestrian gates based on readings from reader(s), according to some embodiments of the present invention. The method 100 allows centrally controlling a plurality of control units based on rules and/or events which are updated in a user profile of a user (e.g. a visitor, a worker and/or a tenant) and to log activity of the user for various usages (including billing and advertisement). The method provide a technical solution to the problem of managing a plurality of access gates optionally of various types and locations using a central management server, optionally based on rules and user profiles which are updated by one or more operators who use management graphical user interfaces. It should be noted that the control of the access gates can be used for parking garage identification and payments, tickets requisitions, and location based messaging system and monitoring as described below.

Figure 2:
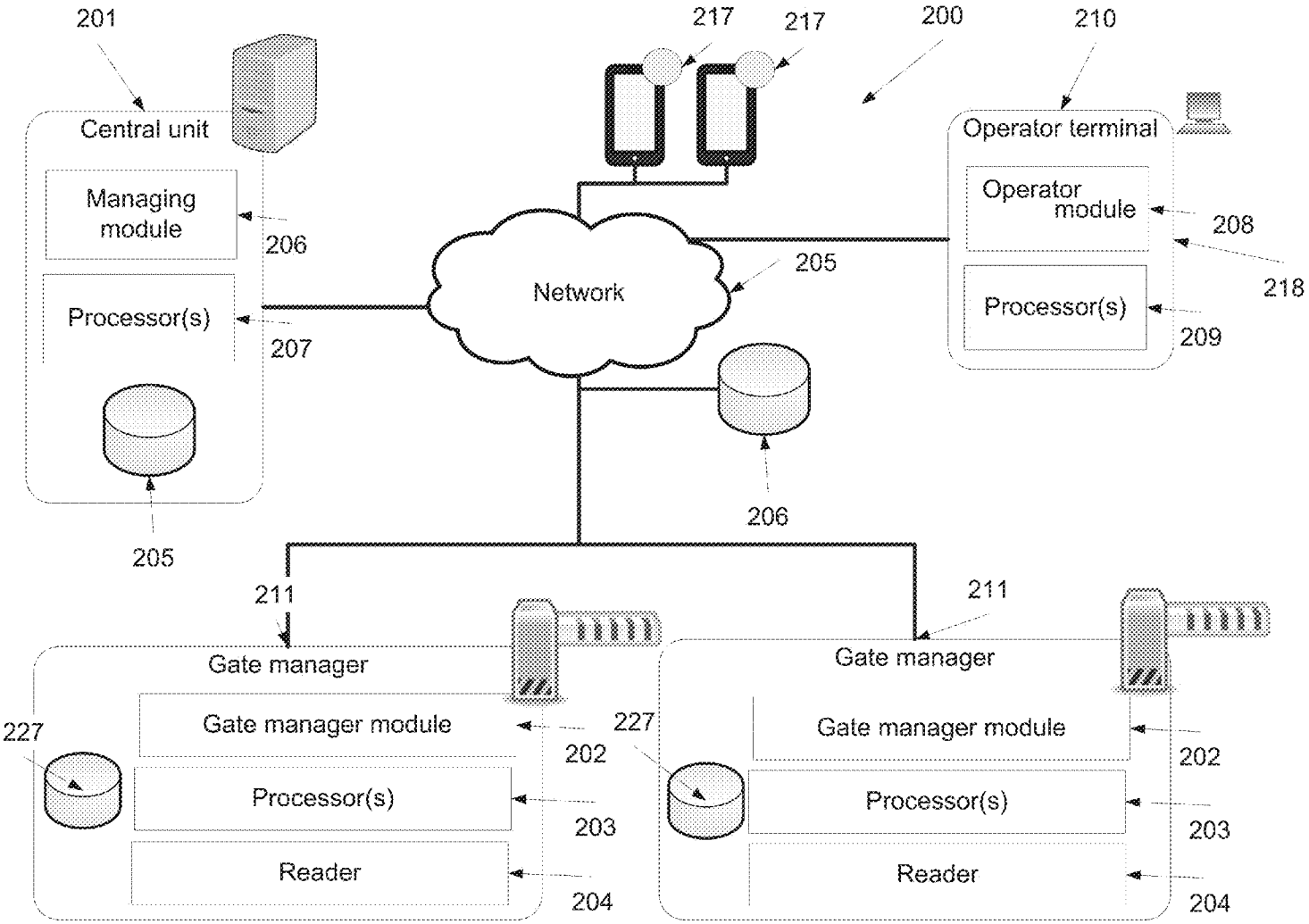
FIG. 2 is a schematic illustration of a system adapted to manage the access of user to various areas, for instance by implementing the method depicted in FIG. 1, according to some embodiments of the present invention.

Reference is now also made to FIG. 2, which is a schematic illustration of a system 200 adapted to manage the access of user to various areas, for instance by implementing the method depicted in FIG. 1, according to some embodiments of the present invention. The system 200 based on a central unit 201 executed on one or more servers or virtual machines and connected to a network, such as the internet. The central unit 201 includes one or more processors 207 which execute a code of a managing module 206 and have access to one or more databases which are either locally or remotely installed as depicted in 205, 206, and 227. The database(s) 205, 206 stores user profile(s) defining user identifiers (e.g. number, phone number, email address, car plate, worker ID number, tenant number and/or the like) at least access right (credentials) of different users to access different areas optionally in different times and/or access rules for applying the user profile(s), for example billing rules, advertisement rules and/or the like. The database(s) 205, 206 optionally stores logs recording access (and optionally trials to access) of users, for instance as part of the user profiles. Local databases 227 may store user profiles (or portions thereof) of users who are granted with credentials to pass via the respective access gates.

Optionally, the system 200 further includes a gate manager module 208, for instance a software, either locally installed or accessed via a browser, which the code thereof is executed by processors 209 of a client terminal 210, such as a desktop, a laptop or a Smartphone, so as to allow a system operator to use the client terminal for updating and/or creating user profiles. The gate manager module 208 may communicate with local or remote databases 205, 206, and 227.

In use, after an access permit is update for a user, a message may be forwarded to the user from the system 200. The message may include a user identifier or an encoded ticket which is associated with the user identifier, for instance a barcode image or a code for inputting into a signal such as an RFID signal or a Wi-Fi signal. The message may be forwarded to an application installed in a mobile device of the user, for example 2017. The message may be forwarded as a Short Message Service (SMS) message or a Multimedia Messaging Service (MMS) with a link to download the image with a generated barcode or the application 217 and/or to a registration webpage for allowing the user to provide his details and optionally to see information about the permit.

The system 200 further includes a plurality of access gate control units 211 which are adapted to communicate with the central unit 201 via the network 205 for opening and closing one or more access gates based on user identifier (or a ticket encoding the user identifier) extracted using a reader 204 and processed based on a code of a gate manager module 202 which is executed using processor(s) 203. The reader 204 may include an imager, such as a camera or an image sensor, such as a Complementary Metal Oxide Semiconductor (CMOS) sensor for imaging a machine readable code, such as a barcode, for instance a QR code that may be generated and/or displayed using a locally installed application. The reader 204 may include a wireless signal reader, such as a Bluetooth™ reader, an NFC reader, and/or a Wi-Fi reader to identify proximity of user by extracting a user identifier (or a ticket encoding the user identifier) from a signal transmitted by a mobile device of a user. Optionally, the gate control unit 211 has a housing that comprises the processors and the reader and optionally connected wirelessly or via wire to the control of the controlled gate(s).

Optionally, the reader comprises a barcode reader, for instance infrared (IR) reader. Optionally, the reader is an image sensor and the unique identity is extracted from a facial image of a user, for instance using a face recognition algorithm that allows extracting biometric features of the user and to match the biometric features with stored biometric features in the memory. Optionally, the reader is a fingertip reader and the unique identity is extracted from fingertip data of a user, for instance using a fingertip recognition algorithm that allows extracting biometric features of the user and to match the biometric features with stored biometric features in the memory.

Figure 3:
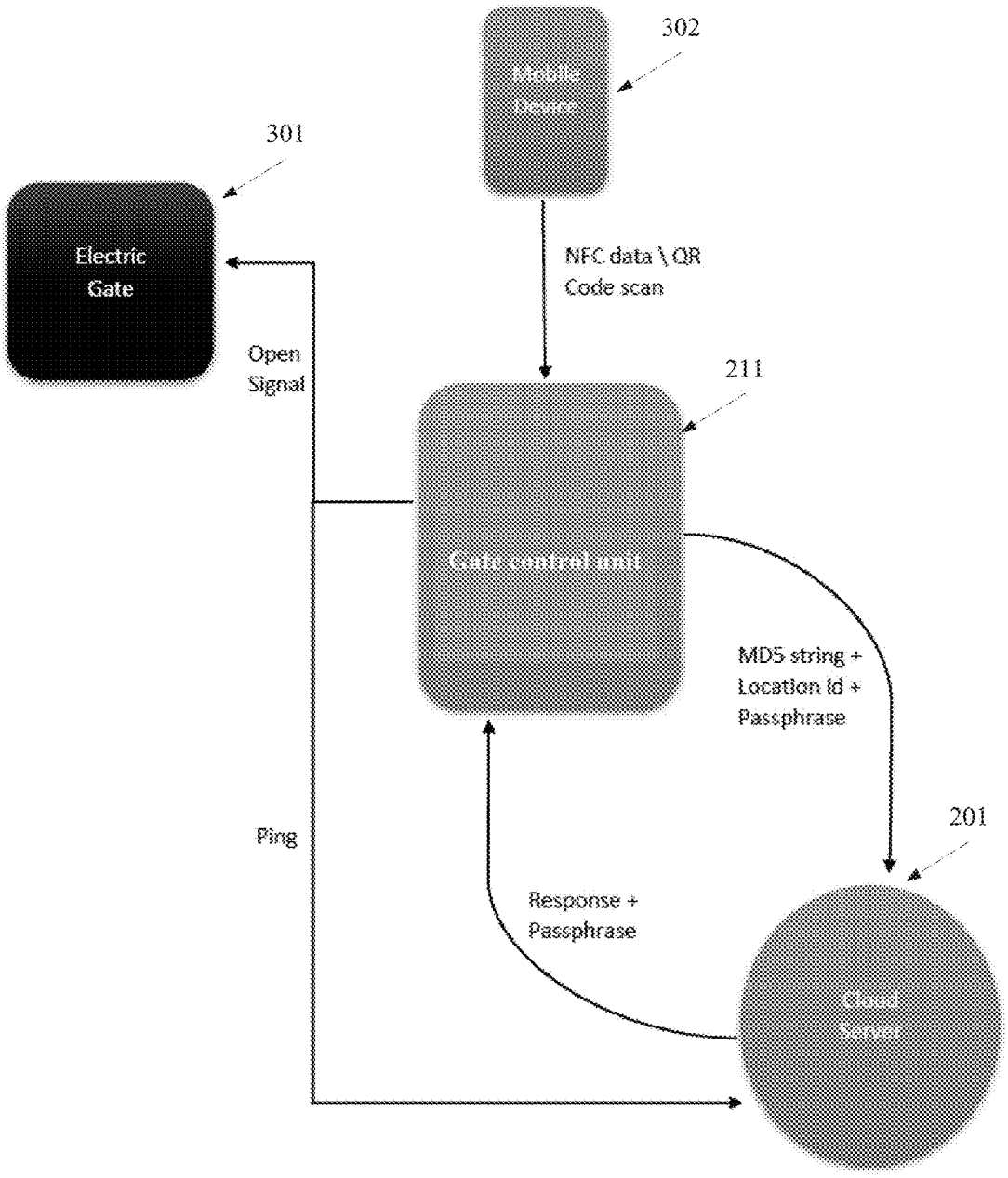
FIG. 3 is an exemplary schematic illustration of communication between an exemplary gate control unit implemented as an add-on and existing electric gate between the exemplary gate control unit and the central unit implemented by a cloud server, according to some embodiments of the present invention.

Optionally, an access gate control unit 211 is an add-on hardware unit which is adapted to communicate with an existing access gate and to instruct the existing access gate to open or close by sending an open and/or close control signals. For example, reference is now also made to FIG. 3 which is an exemplary schematic illustration of communication between an exemplary gate control unit 211 that is implemented as an add-on and existing electric gate between the exemplary gate control unit 211 and the central unit 201 which is implemented by a cloud server, according to some embodiments of the present invention. The access gate control unit 211 optionally includes a microcomputer, such as a microprocessor, and a network interface adapted to communicate with the central unit 201. Optionally, the gate control unit 211 includes memory for storing the code of the gate manager module 202 and/or respective data. The memory may be a memory card, such as a secure digital (SD) card. Optionally, the gate control unit 211 has a power source connection and optionally a backup source, such as a lithium battery pack to avoid failure during power outage. Optionally, the gate control unit 211 a communication array consisting of a Wi-Fi chip, a Global System for Mobile Communications (GSM) mobile broadband internet modem, a Bluetooth chip, a Radio Frequency Identification (RFID) chip and/or NFC chip and optionally a relay controller.

In use, the access gate control unit 211 uses a reader to read a user identifier, for example from a signal transmitted by a mobile device 302 or a displayed code on a display of the mobile device 302 (e.g. as described above) and to locally match the user identifier with local data for authentication and/or forward the user identifier (or a ticket encoding the user identifier), optionally encrypted by a cryptographic hash function, such as a MD5 message-digest algorithm, to the central unit 201. For brevity, a user identifier or any ticket associated or encoding the user identifier are referred to herein as a user identifier. Optionally, the user identifier is forwarded to the central unit 201 only when no local match is found. The message to the central unit 201 may be encoded and include details about the address of the access gate, for instance a building number, an ID of an entity issuing the permit as acquired from the application 217, an access point ID, a Unix timestamp representing the time when the permit becomes active as acquired from the application 217, a Unix timestamp representing the time when the permit becomes inactive as acquired from the application 217, and/or a Unix timestamp representing the time the user generated the code on his mobile device as acquired from the application 217. Optionally, the local databases 227 are updated with user identifiers and credentials of users who are designated to pass via the respective access gates. In such a manner, latency of communication with the central unit 201 in real time can be saved. Moreover, the access gates remain operative in real time. Clearly local data has to be dynamically updated in real time to reflect recent changes. Such updating may be performed continuously or upon an update at the central unit 201. Additionally or alternatively, the user profile records are distributed to be stored in local databases to avoid storage redundancy while reducing latency.

Optionally, a sequence of words or other text, referred to herein a passphrase, is used by access gate control unit 211 to control access to the central unit 201, for example for marking the message with the user identifier as valid. The central unit 201 matches the user identifier, optionally after decryption, with a user profile to determine whether the specific user has a permit to enter an area protected by the gate(s) controlled by the access gate control unit 211, optionally at the current date and time. Optionally, a passphrase is used by the central unit 201 to encode the response to the access gate control unit 211. It should be noted that the access gate control units 211 may be distributed to control various access gates to various area, for instance areas in different buildings, streets, cities or even countries.

Reference is made, once again, to FIG. 1 which depicts actions made at the central unit 201 at the left side and actions made by the access gate control unit 211 at the right side. As depicted in 101 a plurality of user profiles are stored for example in databases 205 and 206 as described above. The plurality of user profiles are optimally generated by the operator module 208 during a process wherein access permits are given to users. Optionally, information about the access permits and the respective user identifiers are distributed to the users via applications messages and/or SMS as described above.

In one example, when an access permit is updated in a user profile of a registered user which downloaded the client module 217 to his device, a notification is sent to the client module 217 to notify the user of the new access permit. When an access permit is updated in a user profile of a new user which is not a registered user of the system, a message is sent to an address of the user (address provided by the operator via the operator module, for example a phone number or an email) using an SMS messaging unit that notify him he has a new permit and sends him to download the app. After the user downloads the client module 217 the user may enter identification details such as personal ID and a mobile phone number (or confirmation of a mobile phone number). After the data is verified by the system 200 a pin code may be sent to the user by SMS to verify the ownership of the mobile device.

As shown at 102, when the access gate control unit 211 identifies a user identifier, for instance based on reader's reading the user identifier is wirelessly forwarded to the central unit, for instance in a format of an access query, as depicted in 103. Optionally, the central unit checks the internet protocol (IP) address of the sender of the message to see if it is originated from any member of a white list of authorized IP addresses.

As shown at 104, the central unit 201 identifies that matching user profile and determines an access permit or denial accordingly. For example, a user identifier or a user identifier ticket issued to the user, such as a number, is extracted from a barcode issued for the user, either in advance or using an application upon request.

The number is locally matched for entry authentication, for example as described herein for the central unit 201 or forwarded to the central unit 201 that identifies accordingly the user profile of the respective user and extracts from the user profile whether the user has credentials to access an area kept by the gate controlled by the access gate control unit 211 of the reader which was used to read the barcode issued for the user. A response that includes the access permit or denial is sent back to the access gate control unit 211, as shown at 105. As shown at 106, based on the response, the access gate control unit 211 sends (or does not send) control signal(s) to operate one or more access gates. Optionally, this action also send a ping to the central unit 201 for logging that the gate has been open, for instance for logging an entrance or an exit based on the current location ID of the access gate control unit 211.

According to some embodiments of the present invention, the operator module 208 allows an operator, such as an office, to manage credentials of visitors and users such as workers and optionally to access user logs documenting actual accesses to facilitates, for instance as a time clock.

Optionally, operator module 208 comprises a graphical user interface (GUI) which may be locally generated by a local process or rendered by a browser based on instructions from the central unit 201. The credentials may be updated in real time.

Optionally, alerts may be generated when a presence of a user in an area does not match his or her credentials, for instance when a visitor remains after defined visiting hours. Optionally, alerts may be generated when a lack of presence of a user in an area does not match his or her credentials, for instance when a worker does not arrive to work and/or leave before the end of a shift. Optionally, the operator module 208 is designed to allow an operator to save their contact book for fast credentials management of employees, visitors, clients and/or the like. Optionally, the operator module 208 is designed to allow an operator to grant a permanent access permit or a time limited access permit. Optionally, the operator module 208 is designed to allow an operator to generate reports with analytics data, as the ability to show which permits were issued, which were used and extended.

Optionally, an administrator module (not shown) is provided and set to allow an administrator to monitor operator modules 208, set restrictions and rules, provide insights on general usage schemes, and find unauthorized usage of the operator modules 208. The administrator module is connected to the operator modules 208 and to the central unit 201 via the network 205.

According to some embodiments of the present invention, as depicted by references, client modules 217 installed in mobile devices, such as 218, allows the central unit 201 to communicate with the users. The client modules 217, for instance applications, such as Android, iOS, Windows Phone, Blackberry OS and/or FireOS applications, are installed on mobile devices such as Smartphones, Smartwatches and tablets and receive messages from the central unit 201, optionally based on the unique identifier of the respective user as extracted from the user profile. The client modules 217 may be used for displaying active access permits given to the user. The client modules 217 may be used as a single pass for multiple locations, for example by transmitting signals and/or displaying barcodes with the user identifier or a ticket that is based on the user identifier. Optionally, the client modules 217 alert the user when an access permit is about to expire and give them the option to send a message to the operator to extend the permit duration.

The client modules 217 may be used as a platform for distributing additional data. For example, promotional content may be sent to the users who are access gate control unit 211 using the client modules 217, for example coupons, advertisements and/or the like. Additionally or alternatively, the client modules 217 allow presenting the users with billing information and to establish a GUI session therewith to complete or approve a charge or a payment. Optionally, billing data and/or promotional content is sent when the user complies with certain terms, for instance enter in an access gate at a certain time and/or with certain people and/or based on access grant given by a certain operator, for example a law firm, a dentist and/or the like.

Optionally, a client module 217 includes a permit GUI to allow the user to see which permits are currently active for him (for example with addresses, gate location, and/or timing) and optionally to request for permit renewals by a click of a button. Optionally navigation button and/or call buttons are added to allow the user to initiate a navigation session or a call by a click of a button.

The methods as described above are used in the fabrication of integrated circuit chips.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

It is expected that during the life of a patent maturing from this application many relevant methods and systems will be developed and the scope of the term a processor, a network, and an image sensor is intended to include all such new technologies a priori.

As used herein the term "about" refers to ±10%.

The terms "comprises", "comprising", "includes", "including", "having" and their conjugates mean "including but not limited to". This term encompasses the terms "consisting of" and "consisting essentially of".

The phrase "consisting essentially of" means that the composition or method may include additional ingredients and/or steps, but only if the additional ingredients and/or steps do not materially alter the basic and novel characteristics of the claimed composition or method.

As used herein, the singular form "a", "an" and "the" include plural references unless the context clearly dictates otherwise. For example, the term "a compound" or "at least one compound" may include a plurality of compounds, including mixtures thereof.

The word "exemplary" is used herein to mean "serving as an example, instance or illustration". Any embodiment described as "exemplary" is not necessarily to be construed as preferred or advantageous over other embodiments and/or to exclude the incorporation of features from other embodiments.

The word "optionally" is used herein to mean "is provided in some embodiments and not provided in other embodiments". Any particular embodiment of the invention may include a plurality of "optional" features unless such features conflict.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. An access control system, comprising:

a storage for storing a plurality of user profiles of a plurality of users, each one of said plurality of user profiles is associated with a unique identifier of one of said plurality of users and defining access credentials of a respective said user to each of a plurality of gates;

a central unit having at least one processor and an access manager module executed by said processor;

a plurality of gate control units each having:

a reader to identify a unique identifier of one of said plurality of users, a network interface for transmitting said unique identifier to said central unit via a computer network and to receive from said central unit a message indicative of approving or rejecting an access of a user identified with said unique identifier to a physical location associated with respective said gate control unit, and a gate controller adapted to instruct an opening of at least one of said plurality of gates based on an analysis of said message;

wherein said access manager module generates said message based on a match between said unique identifier and data from a respective said user profile.

2. The system of claim 1, wherein said access manager module register a presence of said user in a log when said unique identifier is identified.

3. The system of claim 1, wherein said access manager module adds to said message promotional content related to a location of a respective said gate control unit.

4. The system of claim 1, wherein said access manager module sends a mobile device message to a client application running on a mobile device of said user in response to a compliance with a rule and said approving or said rejecting of said access of said user.

5. The system of claim 4, wherein said client application is adapted to extract from respective said user profile information of an access permits to a plurality of locations via at least some of said plurality of gates and to instruct a display of said information on a display of said mobile device.

6. The system of claim 1, wherein said access manager module sends an SMS message to a client application running on a mobile device of said user based on an update to a respective said user profile.

7. The system of claim 1, wherein said plurality of gate control units are installed to control a plurality of car gates and pedestrian gates which are disconnected from one another.

8. The system of claim 1, wherein said plurality of gate control units are installed in a plurality of different buildings.

9. The system of claim 1, wherein at least one of said message and said user identifier is encrypted using a cryptographic hash function.

10. The system of claim 1, further comprising at least one operator module adapted to be executed by a processor so at to allow an operator to edit at least some of said plurality of user profiles.

11. The system of claim 10, wherein said at least one operator module is adapted to display a notification about said opening of said at least one gate.

12. The system of claim 1, wherein said access manager module sends a mobile device message to a mobile device of said user in response to a compliance with a rule and said approving or said rejecting of said access of said user and based on a number acquired from a respective said user profile.

13. The system of claim 1, wherein said reader is an image sensor adapted to read said unique identifier from a machine readable tag presented on a screen of a mobile device of said user.

14. The system of claim 1, wherein said reader is an image sensor adapted to detect a signal encoding said unique identifier and transmitted by a mobile device of said user.

15. The system of claim 1, wherein each of said plurality of gate control units comprises a module for matching said unique identifier with local data and to instruct said network interface to transmit said unique identifier to said central unit when no locally found.

16. A method for access control, comprising:

at a central unit:

storing a plurality of user profiles of a plurality of users, each one of said plurality of user profiles is associated with a unique identifier of one of said plurality of users and defining access credentials of a respective said user to each of a plurality of gates;

at one of a plurality of gate control units installed to control a plurality of electronic gates:

identifying a unique identifier of one of said plurality of users, transmitting said unique identifier to said central unit via a computer network and to receive from said central unit a message indicative of approving or rejecting an access of a user identified with said unique identifier to a physical location associated with respective said gate control unit, and instructing an opening of at least one of said plurality of gates based on an analysis of said message;

wherein said central unit generates said message based on a match between said unique identifier and data from a respective said user profile.

17. A computer readable medium comprising computer executable instructions adapted to perform the method of claim 16.

* * * * *